United States Patent [19]

Brina

[11] 4,177,938

[45] Dec. 11, 1979

[54] CONTAINER WITH MIXING CARTRIDGE

[76] Inventor: Guido J. Brina, 9 Club Cir., Monmouth Beach, N.J. 07750

[21] Appl. No.: 811,587

[22] Filed: Jun. 30, 1977

[51] Int. Cl.[2] ..... B65D 25/08

[52] U.S. Cl. ..... 222/80; 222/130; 206/222; 215/6; 215/DIG. 8; 128/272.1

[58] Field of Search ..... 222/80–81, 222/83, 83.5, 85–88, 91, 130; 215/6, DIG. 8; 206/222; 128/218 M, 272.1; 220/23

[56] References Cited

U.S. PATENT DOCUMENTS

| | | | |
|---|---|---|---|
| 2,911,123 | 11/1959 | Saccomanno | 215/6 X |
| 3,347,410 | 10/1967 | Schwartzman | 206/222 X |
| 3,438,549 | 4/1969 | Ritz | 222/83.5 |
| 3,655,096 | 4/1972 | Easter | 222/82 |

FOREIGN PATENT DOCUMENTS

| | | | |
|---|---|---|---|
| 716477 | 10/1931 | France | 206/222 |
| 92773 | 7/1938 | Sweden | 215/6 |
| 1383404 | 2/1975 | United Kingdom | 206/222 |

*Primary Examiner*—Robert J. Spar
*Assistant Examiner*—Charles A. Marmor
*Attorney, Agent, or Firm*—Weingram & Klauber

[57] ABSTRACT

A container for liquids includes a mixing cartridge extending from a gasket into the neck of the container. The mixing cartridge is asymmetrically disposed with respect to the container to allow a piercing member extending into the container from the cap of the container to be disposed in the container without piercing the cartridge in a storage position. The cartridge is pierced and the contents of the cartridge are mixed with liquid in the container by relative movement of the cartridge and the piercing member of the container so that the piercing member will extend through the cartridge both to pierce the upper and lower surfaces of the cartridge and to provide a flow-path for the contents of the cartridge into the container.

6 Claims, 7 Drawing Figures

CONTAINER WITH MIXING CARTRIDGE

BACKGROUND OF THE INVENTION

1. Field of the Invention

This invention relates to a container with mixing cartridge, and more particularly, to a container for segregating ingredients in two or more chambers until such time as mixing is desired.

2. Description of the Prior Act

A wide variety of compositions have been marketed in packages keeping two components separated until mixed or used. Dual container systems for mixing two-part medicinal, cosmetic, beverage and household products have been provided. In some of these devices a frangible wall separates the two fluid-containing chambers and no control of the amount of one component to be mixed into the other is feasible. Other arrangements include rupturable separating walls or membranes and are prone to premature rupturing, leakage chambers, and incomplete mixing within the container prior to delivery. Exemplary of the recent devices having a frangible wall are those taught by Morane et al in U.S. Pat. No. 3,802,604 and by Lanfranconi et al In U.S. Pat. No. 3,840,136. These devices have coaxial chambers with trocars fitting telescopically within the smaller chambers and being operative by movement along the common axis.

SUMMARY OF THE INVENTION

With the foregoing in mind it is a primary object of the present invention to provide a novel multicompartmented container which will provide a leakproof inner container within a hermetically sealed overall unit and additionally provision for mixing the contents of the containers which cannot be accidentally operated.

Essentially in accordance with the present invention a container for storing separate components is provided which includes a sealed cartridge for holding a substance for release into a larger vessel. The sealed cartridge depends asymmetrically from a gasket which lies in the mouth of the vessel and with an undercap coacting therewith seals the mouth of the vessel. A piercing member is eccentrically connected to the undercap and during storage extends through an aperture in the gasket.

A further object of this invention is to provide a novelty component package which is simple and economical to assemble.

Further object of this invention is to provide a novel device wherein complete mixing of the components is facilitated.

In keeping with the further object of this invention the cartridge is provided with an arcuate wall which serves to center the gasket upon placement in the neck of the larger container.

BRIEF DESCRIPTION OF THE DRAWINGS

The foregoing and other objects, features and advantages of the invention will become apparent from the following description and claims, and from the accompanying drawings in which:

DESCRIPTION OF THE INVENTION

Figure 1:
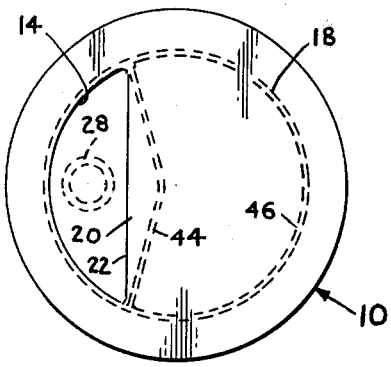
FIG. 1 is a top view of a container of the present invention for storing separate components and showing the container with the spout removed.
Figure 2:
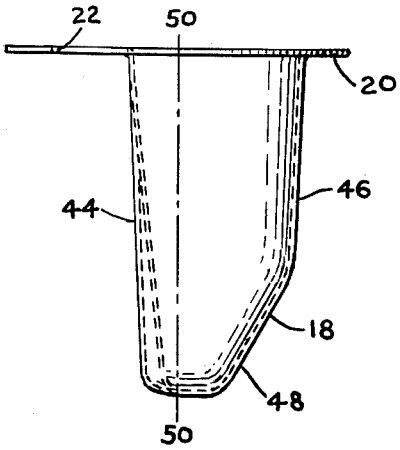
FIG. 2 is a side view of an asymmetrically shaped sealed cartridge of this invention.
Figure 3:
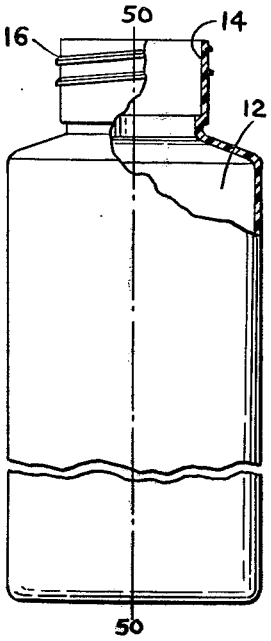
FIG. 3 is a side view which is partially broken away showing a vessel of this invention for receiving the cartridge of FIG. 2.
Figure 4:
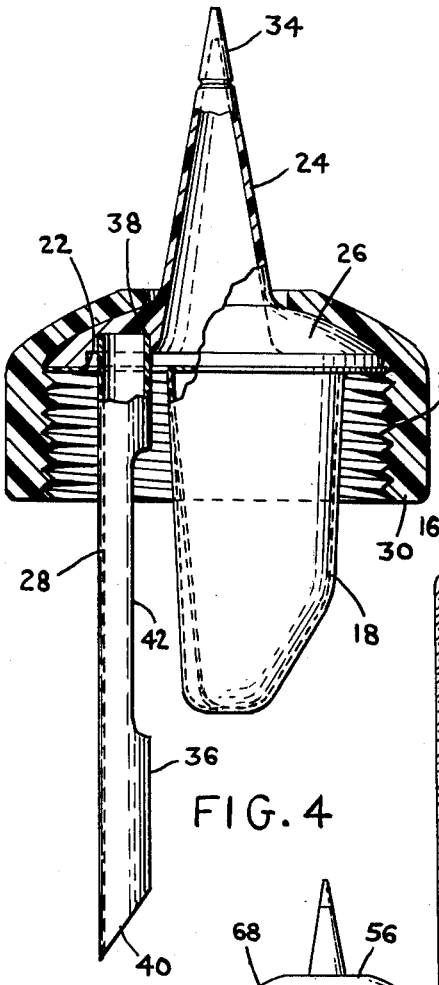
FIG. 4 is a partial cross-sectional view showing the relationship of cap, pouring spout, sealed cartridge and pouring spout of this invention.
Figure 5:
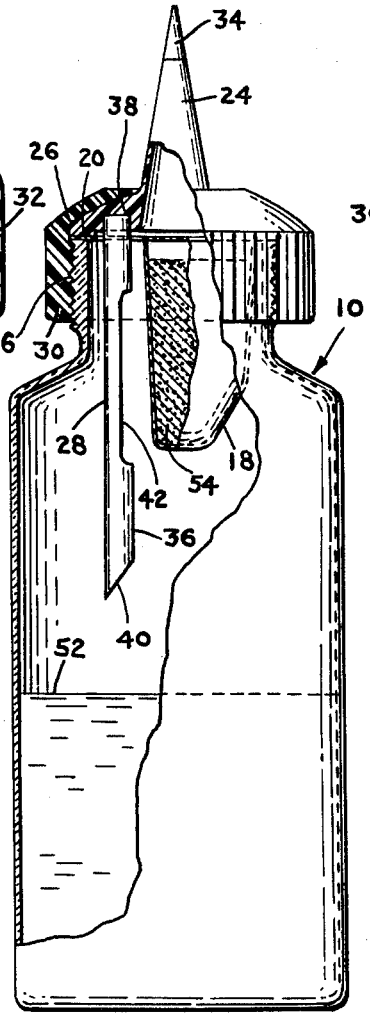
FIG. 5 is a partial cross-sectional view of the container of this invention storing two separate components in readiness for mixing.
Figure 6:
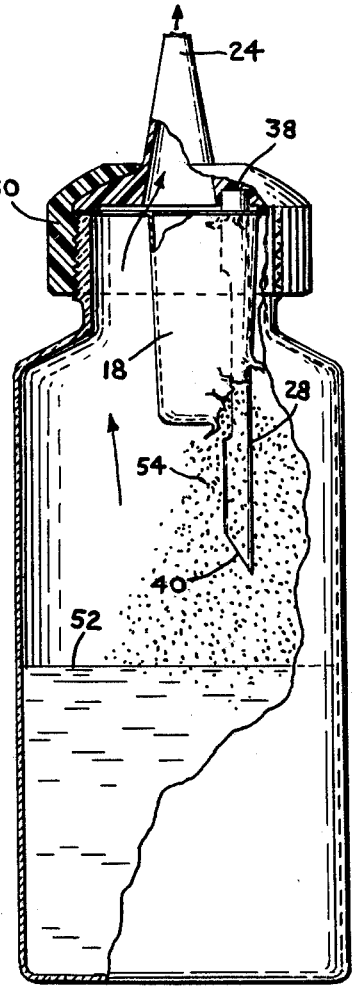
FIG. 6 is a partial cross-sectional view showing the mixing operation of the components shown in FIG. 5.

Referring now to FIGS. 1 through 5, it will be seen that reference designator 10 indicates generally a container or vessel defining therein a chamber 12 and having an upper opening or mouth 14. Vessel 10 may be of glass or plastic fabrication and fashioned with an externally threaded neck 16 for accepting a cap and/or pouring spout. To the mouth 14, a sealed cartridge 18 is asymmetrically fitted by means of a gasket 20. The gasket has an opening 22 therethrough for accommodating a piercing unit. A pouring spout 24 is to extend from structured gasket 20 and is mated to the neck 16. The pouring spout of this embodiment is arranged coaxially with vessel 10 and is mounted upon an undercap 26 in which a piercing unit 28 is eccentrically attached so that during the storage mode of the container the piercing unit is aligned with previously described opening 22. The undercap 26 is independently secured to the container by threaded cap 30, the threads 32 of which mate with those of threaded neck 16. The undercap is structured so that upon removal of the cap 30, the undercap may be removed and rotated thereby altering the alignment of piercing unit 28. A further structural feature of the undercap is that together with gasket 20 and pouring spout 24 and by the securement of cap 30, the chamber 12 is provided with an airtight seal. The pouring spout 24 is equipped with removable tip 34 to permit outflow of mixed product.

The piercing unit 28 is basically a hollow member or cylinder 36 being attached at the upper end 38 thereof to undercap 26. At the opposite end the cylinder is a cutter 40. Medial the ends an opening 42 is provided for passage means between cartridge 18 and chamber 12.

The cell or cartridge 18 is described in the following paragraph with, unless otherwise stated, the longitudinal axis of the vessel 10 vertically disposed. With this orientation and with reference to FIGS. 1 and 2, the cartridge is seen as an irregularly shaped container that has sidewalls 44 and 46 depending downwardly from gasket 20 and dimensioned to conform to the curvature of upper opening 14. In the embodiment illustrated, the cartridge is formed in a sealing relationship to gasket 20 (either integrally therewith or using the gasket as a sealing member). Where as illustrated, the wall 46 is formed in an arcuate manner tracing the opening. Upon exceeding the 180° angle, the cartridge serves to provide self-alignment between gasket 20 and neck 16. Wall 46 is further formed by having the lower portion 48 thereof curve inwardly toward the longitudinal axis 50 of vessel 14. Such structure provides for complete drainage of component stored in cartridge 18. The cartridge 18 may be fabricated from a rigid material that shatters or breaks away from the cutter 40 of piercing unit 28. Alternatively a self-sealing material may be employed for the walls 44 and 46 which structure, after removal of the piercing unit, provides for retention of the balance of the component within the cartridge. Other cartridge structures within the scope of this invention would include additional interior wall means (not shown) preferably vertical and proximately radial with respect to the chamber 12. Such wall means would provide separately accessible components in isolated cells.

The above-described components are assembled by depositing a component of the desired mixture typically a fluid 52, within the chamber 12 of vessel 10, placing thereon a gasket 20 with asymmetrical cartridge 18 attached thereto and depending into the chamber, packaging another component 54 of the desired mixture, inserting the undercap 26 and pouring spout 24 with the piercing unit 28 extending from the undercap and through gasket 22, and finally attaching the undercap with cap 30 thereby sealing chamber 12.

Figure 7:
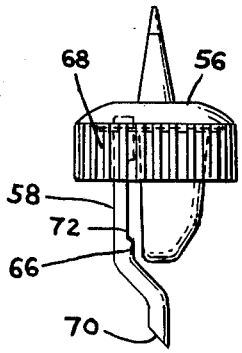
FIG. 7 is a side view similar to FIG. 4, but showing an alternate embodiment of the piercing unit.

Referring now to FIG. 7, another embodiment is shown in which the piercing unit is shown with an affect portion adjacent the cutter. Here the piercing unit 58 is a curved tubular member 66 being attached at the upper end 68 thereof to an undercap 56. At the opposite end 70 the tubular structure is terminated at an acute angle to form a cutter. In the upper portion of member 66, an opening 72 in the wall is provided for passage of component in the cartridge to the larger container. The curved or offset portion of the tubular member 66 is structured to terminate approximately on the longitudinal axis of the container and thereby to deliver the content of the cartridge to the central portion of the vessel. The curved member also provides a structure which is more readily adapted to machine or hand loading of the piercing unit/cartridge assembly into the container.

In operation, mixing of the components is provided by removing cap 30; removing spout 24 and piercing unit 28; rotating the pouring spout and piercing unit until the piercing unit is aligned over the cartridge 18; lowering the piercing unit, while applying manual pressure thereto, and causing the cutter 40 to penetrate the upper surface of the cartridge adjacent to gasket 20 and to continue downwardly to penetrate the lower surface of the cartridge at the lower portion 48 of wall 46. The piercing unit upon penetrating wall 46 provides a passage communicating by way of opening 42 through lower end 40 and into chamber 12. As described above, the geometry of the cartridge provides for complete drainage of the contents 54 so as to provide accurate proportioning between components to be mixed. Upon emptying, cap 30 is secured and mixing instructions (depending upon types of components) are followed. Thereafter, pouring spout tip 34 is removed and the mixture is expelled through spout 24.

While the preferred forms and arrangements have been shown, it is to be clearly understood that various changes in detail and arrangement of parts may be made without departing from the spirit and scope of this disclosure.

What is claimed is:

1. A container for storing separate components and for mixing said components comprising:

a vessel having a mouth;

a cap adapted to engage the mouth of said vessel;

a sealed cartridge disposed in the mouth of said vessel, said sealed cartridge asymmetrically formed to partially fill the mouth of said vessel to leave a passage therein for the flow of liquids therethrough; and having an upper and lower surface a piercing member connected to said cap of said vessel, disposed asymetrically on said cap to extend through the passage in said mouth of said vessel when said cartridge member and said cap are aligned in a first relative position, and to extend through upper and lower surfaces of said cartridge member when said cartridge member and said cap are aligned in a second relative position, so that the contents of said vessel can pass through said passage left in the mouth of said vessel without piercing the cartridge when said piercing member is in said first position, and the contents of said cartridge will be passed through the hole produced by said piercing member upon the positioning of said piercing member through said cartridge.

2. A container as described in claim 1 wherein the upper surface of said cartridge forms a gasket for sealing said vessel.

3. A container as described in claim 2 wherein the side wall of said cartridge abuts the mouth of said vessel at least at three points on an arcuate path exceeding 180°.

4. A container as described in claim 1 wherein the piercing member is tubular in construction and has a first opening in the side thereof and a second opening in the bottom thereof so as to form a conduit between said cartridge and said vessel when in said second relative position.

5. A container as described in claim 4 wherein the piercing member depends through said opening in said gasket and terminates at a point proximate the longitudinal axis said vessel for guiding placement of cap and cartridge.

6. A sealed cartridge adapted for holding a substance for disposal into a larger vessel having a sealed cap comprising:

a gasket member adapted to lie in the mouth of the vessel and coact with the mouth of the vessel and said sealing cap to seal the mouth of the vessel;

a container having a side wall extending from said gasket and having a closed top in contact with said gasket, said container adapted to hold a substance in a sealed condition;

said container disposed asymmetrically beneath said gasket, so as to cover substantially less than the whole undersurface of the gasket;

a passage means in the gasket in registration with said area of the gasket uncovered by the container, said passage means adapted to allow the flow of liquid through the gasket means;

the cap has a piercing unit depending from said cap, said piercing unit is tubular in construction and has a first opening in the side thereof and a second opening in the bottom thereof so as to form a conduit between said container and said vessel when piercing said container; and said passage means in said gasket are adapted to accomodate said piercing unit to enable said piercing unit to guide placement of said cap on said vessel.

* * * * *